US009968172B2

(12) United States Patent
Ismiel-Nash et al.

(10) Patent No.: US 9,968,172 B2
(45) Date of Patent: May 15, 2018

(54) WAX APPLICATOR

(71) Applicants: Sue Seham Ismiel, Kenthurst (AU); Samoel Ismiel, Kenthurst (AU)

(72) Inventors: Nadine Ismiel-Nash, Kenthurst (AU); Sue Seham Ismiel, Kenthurst (AU)

(73) Assignees: Sue Seham Ismiel, Kenthurst (AU); Samoel Ismiel, Kenthurst (AU)

( * ) Notice: Subject to any disclaimer, the term of this patent is extended or adjusted under 35 U.S.C. 154(b) by 78 days.

(21) Appl. No.: 14/395,679

(22) PCT Filed: Apr. 16, 2013

(86) PCT No.: PCT/AU2013/000392

§ 371 (c)(1),
(2) Date: Oct. 20, 2014

(87) PCT Pub. No.: WO2013/163676

PCT Pub. Date: Nov. 7, 2013

(65) Prior Publication Data

US 2015/0080910 A1 Mar. 19, 2015

(30) Foreign Application Priority Data

Apr. 30, 2012 (AU) ..... 2012901681

(51) Int. Cl.
*A45D 26/00* (2006.01)
*A45D 34/04* (2006.01)

(52) U.S. Cl.
CPC ..... *A45D 26/0014* (2013.01); *A45D 26/00* (2013.01); *A45D 34/04* (2013.01)

(58) Field of Classification Search
CPC ..... A45D 26/0014; A45D 26/00; A45D 34/04
USPC ..... 606/134, 162
See application file for complete search history.

(56) References Cited

U.S. PATENT DOCUMENTS 5,632,756 A * 5/1997 Kruglick ..... A61F 11/006 606/160
5,715,850 A * 2/1998 Markgraaf ..... A61F 11/006 132/333
7,585,303 B2 9/2009 Karubian
(Continued)

FOREIGN PATENT DOCUMENTS

GB 2457024 A 8/2009
WO 1998/01096 A1 1/1998

OTHER PUBLICATIONS

International Search Report for PCT/AU2013/000392, dated May 13, 2013; ISA/AU.

(Continued)

*Primary Examiner* — Sarah W Aleman
(74) *Attorney, Agent, or Firm* — Harness, Dickey & Pierce, P.L.C.

(57) ABSTRACT

A wax applicator is provided for applying epilation wax to nasal cavities, comprising a stem for handling the wax applicator, a nipple at one end of the stem, and a collar disposed around the stem at a base of the nipple, wherein the nipple has a contoured surface that narrows at its base where it meets the collar, operatively to achieve formlock with hardened epilation wax following cooling of hot epilation wax applied to the nipple, and thereby allowing removal from their roots of hairs set in the hardened epilation wax.

10 Claims, 2 Drawing Sheets

(56) References Cited

U.S. PATENT DOCUMENTS

| | | | | |
|---|---|---|---|---|
| 2009/0163933 | A1 | 6/2009 | DiMaio | |
| 2013/0103053 | A1* | 4/2013 | Lewis | A45D 26/0014 606/134 |

OTHER PUBLICATIONS

International Preliminary Report on Patentability for PCT/AU2013/000392, dated Mar. 26, 2014; ISA/AU.
Supplementary European Search Report for PCT/AU2013/000392, EP Application No. EP13784286 dated Nov. 6, 2015.

* cited by examiner

WAX APPLICATOR

CROSS REFERENCE TO RELATED APPLICATIONS

This application is a U.S. National Phase Application under 35 U.S.C. 371 of International Application No. PCT/AU2013/000392 filed on Apr. 16, 2013 and published as WO 2013/163676 A1 on Nov. 7, 2013. This application is based on and claims the benefit of priority from Australian Patent Application No. 2012901681 filed Apr. 30, 2012. The entire disclosures of all of the above applications are incorporated herein by reference.

FIELD OF THE INVENTION

The present invention relates to hair removal, and relates especially to the removal of unsightly hair from sensitive areas of the human body, in particular the nasal cavities.

BACKGROUND OF THE INVENTION

Hair removal takes many forms, and is performed for a diverse range of reasons. Hair removal by epilation involves removing the entire hair, from its root, whereas depilation refers only to techniques that remove that part of the hair which is above the skin.

Epilation is generally preferred, as the entire hair is removed, and consequently the results are longer lasting. With depilation techniques, regrowth is immediately apparent.

Waxing is one epilation technique that is widely used and accepted. Waxing is performed, typically as a service, and by appointment at a salon offering a range of beauty-oriented treatments. Increasingly, though, a range of self-application waxes are available for home use. Hard waxes are widely favoured for coarse hair, and are used by first heating the wax to achieve a viscous consistency for application, and then waiting for the wax to set hard upon cooling, following application.

Waxing can be performed extensively over the body, but is not typically suitable for certain areas of the body—such as the nasal cavities.

Unsightly hair can instead be removed from the nasal cavities using tweezers, though this method is generally avoided as it can be quite painful and unpleasant. Various forms of electric clippers can be used, but such appliances are not widely favoured, and in any case suffer the same problems as other depilation techniques.

There exist, in view of the foregoing, a need for improved techniques and appliances that at least attempt to address these and other deficiencies of existing hair removal techniques.

SUMMARY OF THE INVENTION

The present invention resides in a recognition that hair removal from the nasal cavities can be advantageously effected using epilation waxes applied using a wax applicator having a nipple and collar appropriately configured and dimensioned to allow application of epilation wax to a nasal cavity, leaving the applicator's nipple in place until the wax has set hard, and then withdraw the applicator with the hard set wax, and the hairs set therein.

Consequently, the present invention—in one aspect—relates to a wax applicator comprising a handle in the form of a stem, a nipple at one end of the stem, and a collar disposed around the stem at the base of the nipple. The nipple has a contoured surface with a relatively larger diameter region which narrows towards where the nipple meets the collar—this nipple configuration enhances formlock of hardened epilation wax onto the nipple so that nasal hairs can be removed from their roots upon the nipple being pulled out from the nasal cavity.

Hot epilation wax is applied to the nipple, by dipping the nipple in liquefied wax, and applied through the nostril on to the nasal cavity tissue. The collar discourages the hot wax from draining away from the nipple, and also contributes in securing the formlock with the wax as it cools and hardens. Hairs that have set in the wax are removed from their roots as the wax applicator is withdrawn from the nostril.

The handle or stem can be in its simplest configuration rod-like, but may also be ergonomically shaped to provide improved grip and allow easy manual handling of the wax applicator. The collar can be of any configuration that promotes formlock as well as having a size to minimise hot wax dripping onto the stem, while avoiding outsized arrangements that would interfere with placement of the nipple into the nasal cavity.

Advantageously, the nipple has a smooth surface for user comfort during insertion. Nonetheless, the surface may be dimpled or engraved to increase formlock of the nipple with the hardened wax and thus minimise the potential for wax becoming dislodged from the nipple—and remain in the nasal cavity—in the process of removal of the applicator. In the removal process, tension is applied to the nasal hair entrapped in the solidified wax via the stem which has to be sufficient to release the hair (and its follicle) from the nasal lining tissue; if the formlock is not sufficient it may lead to detachment of wax from the nipple.

The present invention—in another aspect—further provides a method of removing hair from nasal cavities using such a wax applicator, and comprising the steps of applying a quantity of heated epilation wax to the nipple of the applicator;

inserting the nipple of the wax applicator into a nasal cavity using the stem of the wax applicator; allowing the epilation wax to set hard within the nasal cavity; and removing the wax applicator from the nasal cavity, thereby also removing hairs entrapped by the hardened epilation wax.

The wax applicator permits the convenient use of existing hard-setting epilation waxes for the removal of unsightly hairs from nasal cavities. Moreover, the pain and unpleasantness of using a pair of tweezers to perform this task is avoided, and a more satisfactory result is obtained compared to the use of electric clippers and similar devices.

The wax applicator is configured to allow insertion, but reduce the risk of over-insertion, and consequent disruption sensitive membranes that line the nasal cavities, and in particular the fine hair-like cilia which line these membranes. The cilia perform physiological functions within the nasal cavities, and are advantageously not disturbed.

DETAILED DESCRIPTION OF PREFERRED EMBODIMENTS

Figure 1:
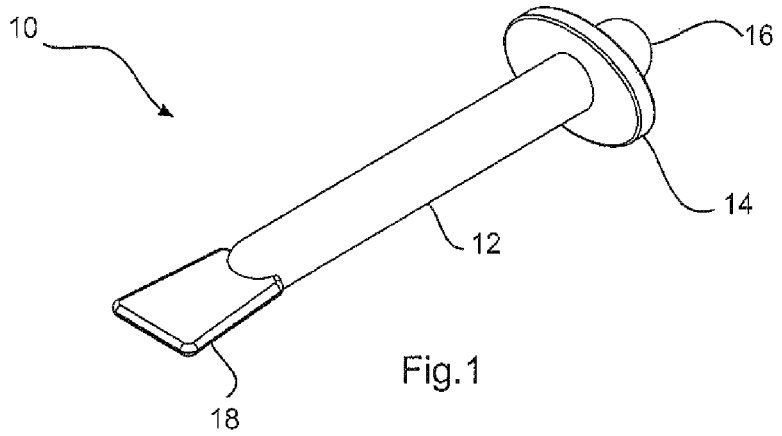
FIG. 1 is a perspective view of a wax applicator according to a preferred embodiment of the present invention.
Figure 2:
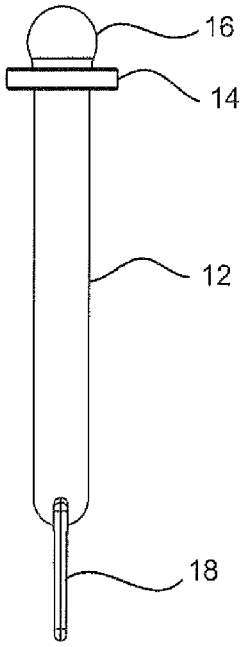
FIGS. 2 to 5 are respectively side, plan, and end views of the wax applicator of FIG. 1.
Figure 3:
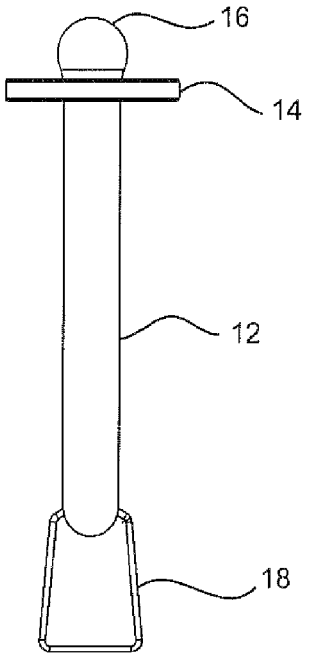
Figure 4:
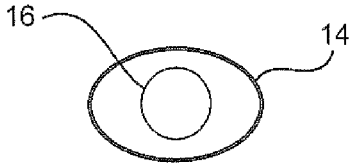
Figure 5:
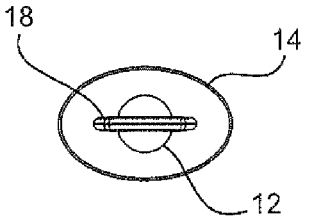

FIGS. 1 to 5 collectively represent different views of a wax applicator 10 according to an embodiment of the present invention.

The wax applicator 10 consists of a stem 12, a collar 14, a nipple 16 and a spatula 18 at the distal end opposite the nipple. The wax applicator 10, as depicted, is generally of an elongate construction (owing primarily to the stem 12) and is manufactured of a suitable thermoplastic polymeric material, such as polypropylene. Other suitable materials include polyethylene, polystyrene, polyvinyl chloride and polytetrafluoroethylene.

The stem 12 may be molded solid or hollow, and provides a convenient means of handling the wax applicator 10. Consequently, the stem 12 is advantageously dimensioned to allow for ease of manual handling of the wax applicator 10, and is preferably of a simple, circularly cylindrical form.

The nipple 16 has a smooth, contoured surface and has a generally rounded, bulbous shape/contour. The nipple 16, as depicted in the preferred embodiment of FIGS. 1 to 5, is shaped to conform to a substantial degree with that of a major portion of an idealized spheroid, preferably a regular spheroid or sphere. Alternatively, the nipple 16 may be of alternative shape, such as a spheroid which is elongated slightly along a major axis of the stem 12, thus taking the form of a prolate spheroid. Thus, the nipple 16 presents a regular, rotationally symmetrical shape, which narrows slightly from its maximum diameter before it meets the collar 14. Consequently, the nipple 16 is recessed where it meets the collar 14, and has a channelled, stepped-in or concave form, which assists in creating formlock with epilation wax that has hardened on nipple 16, to thereby enhance hair removal with the hardened wax.

The collar 14, which is generally elliptical in shape in the preferred embodiment, advantageously serves two roles.

First, the collar 14 allows insertion of the wax applicator 10, but guards against over-insertion of the wax applicator 10—that is, more particularly, over-insertion of the nipple 16 of the wax applicator 10 in the nasal cavity. Over-insertion is to be avoided to reduce the risk of irritating or damaging sensitive membranes and associated cilia that line the inner surfaces of the nasal cavities. These membranes and associated cilia are located at a distance inwardly of the openings of the nasal cavities.

Second, the collar 14 discourages heated epilation wax from running down the stem 12, and in this respect, also assists the viscous, cooling epilation wax in collecting or pooling at the base of the nipple 16, where it narrows. Once the wax is set, formlock is achieved between the nipple 16 and the set wax, such that the wax applicator 10 can be used to transmit tension through to the hardened wax, and thus the hairs set in the wax, which are consequently prised loose from their roots.

With experience, one becomes familiar with how much force is sufficient to effect quick and clean removal of hairs trapped in the wax from their roots. Quick and clean removal is intended to largely avoid pain or discomfort which may otherwise ensue.

The wax applicator 10 may be advantageously fabricated using a suitable injection technique, and be of an integral construction, or fabricated in parts that are subsequently joined using, for example, ultrasonic welding techniques. A diverse range and combination of manufacturing techniques may be used when constructing preferred and other embodiments of the wax applicator, as would be apparent to one skilled in the relevant arts.

The wax applicator 10 is preferably of relatively compact dimensions. Indicative dimensions of the applicator 10 being preferably 90 mm in total length, from the tip of the nipple 16 to the end of the spatula 18. The collar 14, being elliptical in shape, is preferably dimensioned to be 25 mm along its major dimension, and 16 mm along its minor dimension. The stem is preferably 8 mm in its outer diameter, with the nipple 16 extending approximately 10 mm above the collar 14, and having a maximum width (or diameter) of approximately 10 mm. The nipple 16 is recessed where it meets the collar 14, and may be approximately 8 mm in diameter at this region. The collar is preferably 3 mm in thickness, and the spatula 18 is preferably 20 mm in length, and is preferably a little wider than the stem. These indicative dimensions can be varied as required, as is understood by skilled persons.

While generally rigid, the wax applicator 10 can be constructed with a certain amount of flexibility or resilience while maintaining its function. Moreover, a certain amount of resilience is preferred for reasons of aesthetic tactile appeal, and comfort during use. Also, a certain amount of resilience to the stem 12 can act to moderate forces acting through the wax applicator 10 upon the hairs during use. Also, a certain amount of resilience is particularly desirable, though not essential, in the spatula 18.

Figure 6:
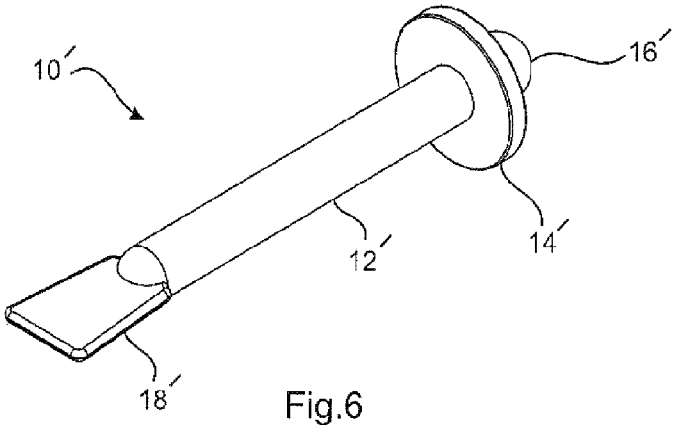
FIG. 6 is a perspective view of a wax applicator according to an alternative embodiment of the invention.

FIG. 6 depicts a wax applicator 10', in accordance with an alternative embodiment, in perspective view. The collar 14' is circular rather than elliptical in construction, as with the collar 14 of the wax applicator 10 of the preferred embodiment. As will be appreciated, the collar 14' can be of any design and dimensions suitable for guarding against over-insertion of the nipple 16', and discouraging the heated (and thus unset) epilation wax from draining down the stem 12'. While an elliptical construction provides a functional and pleasing design, circular and other designs may also be adopted. Further examples include collars which are of rounded rectangular, or polygonal (eg, pentagonal, hexagonal, octagonal, etc) design. The collar 14 is depicted as having a flat, plate-like structure, but can also be curved or cupped as required. Other suitable shapes can be adopted with similar results.

Figure 7:
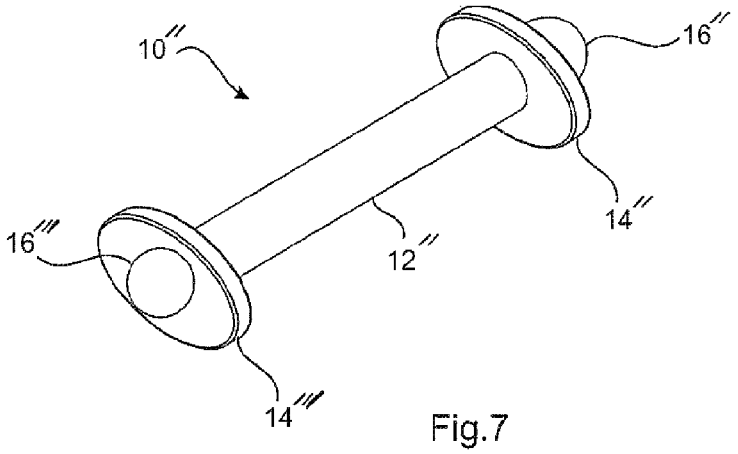
FIG. 7 is a perspective view of an application according to a further alternative embodiment of the invention.

FIG. 7 depicts another wax applicator 10", in accordance with yet a further alternative embodiment, also presented in perspective view. Here, compared with the wax applicator 10 of the preferred embodiment, the spatula 18 is omitted entirely, and replaced by another collar 14'" and another nipple 16'". The nipple 16'" may advantageously have different dimensions to those of the nipple 16" at the opposite distal end of the applicator 10". It could equally have a different shape, eg prolate spherical as compared with circular spherical. Such double-ended applicator 10" has the advantage that it can accommodate users having differently contoured/shaped or dimensioned nostrils.

In a non-illustrated embodiment, the stem 12" can terminates simply in a rounded end. The spatula 18 is an entirely optional feature of the wax applicator 10 of the preferred embodiment. Accordingly, an accompanying spatula can be omitted for simplicity of construction, and may be preferred for aesthetic reasons, and in the interests of producing a more compact or elegant design.

Further alternative designs for a wax applicator may be provided in accordance without departing from the teachings of the present invention. Yet further additional designs may provide an enlarged collar supporting two nipples, arranged adjacently in a spaced apart manner for simultaneous application of hot wax, and simultaneous application to both nostrils in one operation. Also, a handle may be provided not as a simple stem but as a ring grip or contoured finger grip (for one, two, three or four fingers) a means of holding the wax applicator.

A variety of further alternatives may be readily conceived by persons skilled in the relevant arts. Various modifications and variations to the described wax applicators are within the ambit of persons skilled in the relevant arts, without departing from the present invention.

The invention claimed is:

1. A wax applicator for removing nasal hairs, comprising:
a handle for handling the wax applicator,
a nipple at one end of the handle, and
a collar disposed at a base of the nipple, wherein
the nipple, handle, and collar are of integral molded construction,
the nipple has a continuous, solid outer surface and a shape which generally conforms with a major portion of a spheroid having a contoured surface that narrows at its base where the nipple meets the collar, and the nipple is configured to receive epilation wax in use of the wax applicator, and
the collar is of a substantially planar configuration protruding radially outward from the handle thereby defining a waist between the nipple base and the collar in which hardened epilation wax form-locks with the wax applicator for removing nasal hairs in use of the wax applicator.

2. The wax applicator according to claim 1, wherein the nipple has the shape of a truncated regular sphere.

3. The wax applicator according to claim 1, wherein the collar has a shape which generally conforms with an ellipse.

4. The wax applicator according to claim 1, wherein the handle is a stem having a shape which generally conforms with a cylinder having a circular cross-section.

5. The wax applicator according to claim 1, wherein the nipple is dimensioned to allow for insertion of the nipple into nasal cavities, and wherein the collar is dimensioned to limit against over-insertion of the applicator into nasal cavities.

6. The wax applicator according to claim 1, wherein the collar is shaped and dimensioned to restrict or prevent heated wax applied to the nipple from running down the handle during use.

7. The wax applicator according to claim 1, wherein the nipple, handle and collar are formed using a thermosetting polymeric material.

8. The wax applicator according to claim 1, wherein the nipple extends about 10 mm above the collar.

9. A method for removing hair from nasal cavities using a wax applicator comprising a handle for handling the wax applicator, a nipple at one end of the handle, and a collar disposed at a base of the nipple, wherein the nipple, handle, and collar are of integral molded constructions, the nipple has a continuous, solid outer surface and a shape which generally conforms with a major portion of a spheroid having a contoured surface that narrows at its base where the nipple meets the collar, the nipple is configured to receive epilation wax in use of the wax applicator, and the collar is of a substantially planar configuration protruding radially outward from the handle thereby defining a waist between the nipple base and the collar in which hardened epilation wax form-locks with the wax applicator for removing nasal hairs in use of the wax applicator, the method comprising the steps of:
applying a quantity of hot epilation wax to the nipple of the wax applicator,
inserting the nipple of the wax applicator into a nasal cavity using the handle of the wax applicator,
allowing the epilation wax to cool and set hard around the nipple and collar and within the nasal cavity, and
removing the wax applicator from the nasal cavity causing removal of hairs trapped in the hardened epilation wax from their roots.

10. The method for removing hair from nasal cavities using a wax applicator according to claim 9, wherein the nipple of the wax applicator extends about 10 mm above the collar.

* * * * *